US007877047B2

(12) United States Patent
Miyoshi

(10) Patent No.: US 7,877,047 B2
(45) Date of Patent: Jan. 25, 2011

(54) DEVELOPING DEVICE, PROCESS CARTRIDGE AND IMAGE FORMING APPARATUS TO INHIBIT THE INCREASE OF THE RATE OF UNCHARGED TONER DURING PROLONGED OPERATION

(75) Inventor: Yasuo Miyoshi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 85 days.

(21) Appl. No.: 11/848,961

(22) Filed: Aug. 31, 2007

(65) Prior Publication Data

US 2008/0056747 A1 Mar. 6, 2008

(30) Foreign Application Priority Data

Sep. 4, 2006 (JP) ..... 2006-239570

(51) Int. Cl.
*G03G 15/09* (2006.01)

(52) U.S. Cl. ..... 399/267

(58) Field of Classification Search ..... 399/58, 399/253, 267, 272, 273
See application file for complete search history.

(56) References Cited

U.S. PATENT DOCUMENTS

| | | | | |
|---|---|---|---|---|
| 5,044,313 | A * | 9/1991 | Yuge et al. | 399/103 |
| 5,206,690 | A * | 4/1993 | Shimizu et al. | 399/276 |
| 5,619,765 | A | 4/1997 | Tokita et al. | |
| 5,638,842 | A | 6/1997 | Tokita et al. | |
| 6,505,014 | B2 | 1/2003 | Aoki et al. | |
| 6,658,227 | B2 | 12/2003 | Oyama et al. | |
| 6,671,484 | B2 | 12/2003 | Miyoshi et al. | |
| 6,721,516 | B2 | 4/2004 | Aoki et al. | |
| 6,778,805 | B2 * | 8/2004 | Kai et al. | 399/346 |
| 7,035,575 | B2 | 4/2006 | Ikeguchi et al. | |
| 7,181,155 | B2 | 2/2007 | Aoki et al. | |
| 7,209,685 | B2 | 4/2007 | Oyama et al. | |
| 2003/0086728 | A1 * | 5/2003 | Kikuchi | 399/272 |
| 2006/0198663 | A1 | 9/2006 | Miyoshi et al. | |
| 2006/0228135 | A1 | 10/2006 | Miyoshi | |

FOREIGN PATENT DOCUMENTS

| | | |
|---|---|---|
| JP | 5-6103 | 1/1993 |
| JP | 2001-92249 | 4/2001 |
| JP | 2002-258604 | 9/2002 |
| JP | 2005-275069 | 10/2005 |

* cited by examiner

*Primary Examiner*—David M Gray
*Assistant Examiner*—Billy J Lactaoen
(74) *Attorney, Agent, or Firm*—Oblon, Spivak, McClelland, Maier & Neustadt, L.L.P

(57) ABSTRACT

A developing device, which can inhibit the increase of the rate of uncharged toner caused by long hours of operation and develop an excellent image, and a process cartridge and an image forming apparatus that use such a developing device. A developing sleeve is rotary driven, and has, as magnetic field generating means that is fixedly disposed within the developing sleeve, a magnet roll composed of a plurality of stationary magnets. The magnet roll has five magnetic poles, P1 (south pole), P2 (north pole), P3 (north pole), P4 (south pole) and P5 (north pole), which are arranged in the direction of rotation of the developing sleeve in this order starting from a developing position that is a region facing a photoreceptor. On the periphery of the developing sleeve, there is disposed blade-shaped developer accumulation means, which is attached to a developer container at a position between a doctor blade and a stirring section and in the vicinity of the stirring section, with a predetermined space between the developing sleeve and the developer accumulation means.

17 Claims, 8 Drawing Sheets

DEVELOPING DEVICE, PROCESS CARTRIDGE AND IMAGE FORMING APPARATUS TO INHIBIT THE INCREASE OF THE RATE OF UNCHARGED TONER DURING PROLONGED OPERATION

BACKGROUND OF THE INVENTION

1. Field of the Invention

The present invention relates to a developing device for use in a copying machine, a facsimile device, a printer or the like, and to a process cartridge and an image forming apparatus using the developing device. Particularly, the present invention relates to a developing device that performs development using a two-component developer composed of a toner and a magnetic carrier, and to a process cartridge and an image forming apparatus using the developing device.

2. Description of the Related Art

There has been conventionally known a developing device that uses a two-component developer composed of a magnetic carrier and a toner. Such a developing device using the two-component developer generally deposits the developer on a developer carrier as a so-called magnetic brush, regulates the thickness of the developer layer to a predetermined thickness, and then develops an electrostatic latent image on a latent image carrier such as a photoreceptor. As the developer carrier, for example, the one having a cylindrical developing sleeve, which is disposed rotatably and carries and conveys the two-component developer, and a magnet roll, which is fixedly disposed within the developing sleeve and has a plurality of magnetic poles arranged around the magnet roll, are used.

Incidentally, the distance between the latent image carrier and the developer carrier needs to be reduced in order to faithfully develop the electrostatic latent image held on the latent image carrier. If the distance between the latent image carrier and the developer carrier is reduced, the thickness of the developer layer formed on the developer carrier accordingly needs to be reduced.

As a conventional technique for regulating the thickness of the developer layer on the developer carrier, there has been widely used a method of regulating the thickness of the developer layer by using a developer regulating member against the developer carrier and using a fixed space formed between a leading end of the developer regulating member and the surface of the developing sleeve (referred to as "doctor gap" hereinafter). When using this method, the amount of developer passing through the developer regulating member can be adjusted by controlling the doctor gap, but the doctor gap needs to be set extremely small in order to form a thin layer of the developer. However, if the doctor gap is small, the amount of developer passing through the doctor gap fluctuates more significantly than when the doctor gap is large, and thereby the layer thickness of the developer formed on the developer carrier becomes nonuniform. Moreover, great stress is applied to the developer when the developer passes through the doctor gap, reducing the life of the developer.

In order to solve such problems, Japanese Unexamined Patent Publication No. H5-6103, for example, proposes a developing device in which magnetic poles of the same polarity are adjacently disposed on a magnet roll of a developer carrier, a developer regulating member is provided between the magnetic poles of the same polarity, and the packing density of a developer in the doctor gap is reduced by using repulsive magnetic fields of these magnetic poles so as to reduce the amount of developer passing through the doctor gap.

However, in this conventional developing device, the developer tends to accumulate in the doctor gap due to long hours of operation and, as a result, the rate of uncharged toner increases, causing a problem that an abnormal image with a scumming or the like is generated easily.

SUMMARY OF THE INVENTION

The present invention is contrived in order to solve the above problems. It is an object of the present invention to provide a developing device capable of preventing the rate of uncharged toner from being increased by long hours of operation, to develop an excellent image, and a process cartridge and an image forming apparatus that use the developing device.

In an aspect of the present invention, a developing device comprises a developer carrier that has therein a magnetic field generating device having a plurality of magnetic poles, and carries and conveys a two-component developer composed of a toner and a magnetic carrier; a developer regulating member that regulates a layer thickness of the two-component developer carried and conveyed by the developer carrier; a stirring section that stirs the toner and the two-component developer removed from the developer carrier; and a developer accumulation device for accumulating the two-component developer between the stirring section and the developer regulating member. Some of the two-component developer is fed back to the stirring section by the developer accumulation device.

In another aspect of the present invention, a process cartridge comprises a developing device. The developing device comprises a developer carrier that has therein a magnetic field generating device having a plurality of magnetic poles, and carries and conveys a two-component developer composed of a toner and a magnetic carrier; a developer regulating member that regulates a layer thickness of the two-component developer carried and conveyed by the developer carrier; a stirring section that stirs the toner and the two-component developer removed from the developer carrier; and a developer accumulation device for accumulating the two-component developer between the stirring section and the developer regulating member. Some of the two-component developer is fed back to the stirring section by the developer accumulation device.

In another aspect of the present invention, an image forming apparatus comprises a developing device. The developing device comprises a developer carrier that has therein a magnetic field generating device having a plurality of magnetic poles, and carries and conveys a two-component developer composed of a toner and a magnetic carrier; a developer regulating member that regulates a layer thickness of the two-component developer carried and conveyed by the developer carrier; a stirring section that stirs the toner and the two-component developer removed from the developer carrier; and a developer accumulation device for accumulating the two-component developer between the stirring section and the developer regulating member. Some of the two-component developer is fed back to the stirring section by the developer accumulation device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

First, the inventor of the present invention has investigated the occurrence of an abnormal image having a scumming or the like in a developing device, which has: a developer carrier that has magnetic field generating means having fixed therein a plurality of magnetic poles and carries and conveys a two-component developer as a magnetic brush, which is composed of a toner and a magnetic carrier; and a developer regulating member that regulates the thickness of a layer of the developer carried and conveyed by the developer carrier. As a result of the investigation, the inventor has discovered that when the developer carried by the developer carrier accumulates before a doctor gap regulating the thickness of the developer layer, the rate of uncharged toner increases in the toner of the developer accumulated during long hours of operation, and that this uncharged toner is one of the reasons for the occurrence of scumming and the like.

As a result of further investigation performed for solving this problem, the inventor has discovered that it is necessary to inhibit the accumulation of the developer before the doctor gap as much as possible, and to sufficiently stir the developer removed from the developer carrier by the magnetic field generating means and a new replenished toner by means of a stirring section so as to uniformly mix the toner and developer. As a result of investigation performed based on this result, the inventor has discovered that the increase of the uncharged toner rate can be inhibited by providing developer accumulation means between the stirring section and the doctor gap, causing the developer accumulation means to accumulate the developer, and feeding the accumulated developer to the stirring section.

It is desired that the developer accumulation means be disposed between the stirring section and doctor gap and particularly adjacent to the stirring gap in order to prevent the developer from being accumulated before the doctor gap. Moreover, it is desired that the mixture of the developer removed from the developer carrier and the toner be accumulated properly between the stirring section and the doctor gap, particularly in the vicinity of the stirring section, by the developer accumulation means. As with the developer regulating member that forms a doctor gap, the following members can be used effectively as a member that satisfies the abovementioned conditions: a blade-like developer regulating member that physically regulates partial conveyance of the developer carried and conveyed by the developer carrier, or, as described hereinafter, a member that magnetically applies a transfer force to the direction that causes the developer to flow backward in the conveyance direction of the developer carrier, to accumulate the developer.

Hereinafter, the present invention is described in detail with reference to the drawings.

First Embodiment

Figure 1:
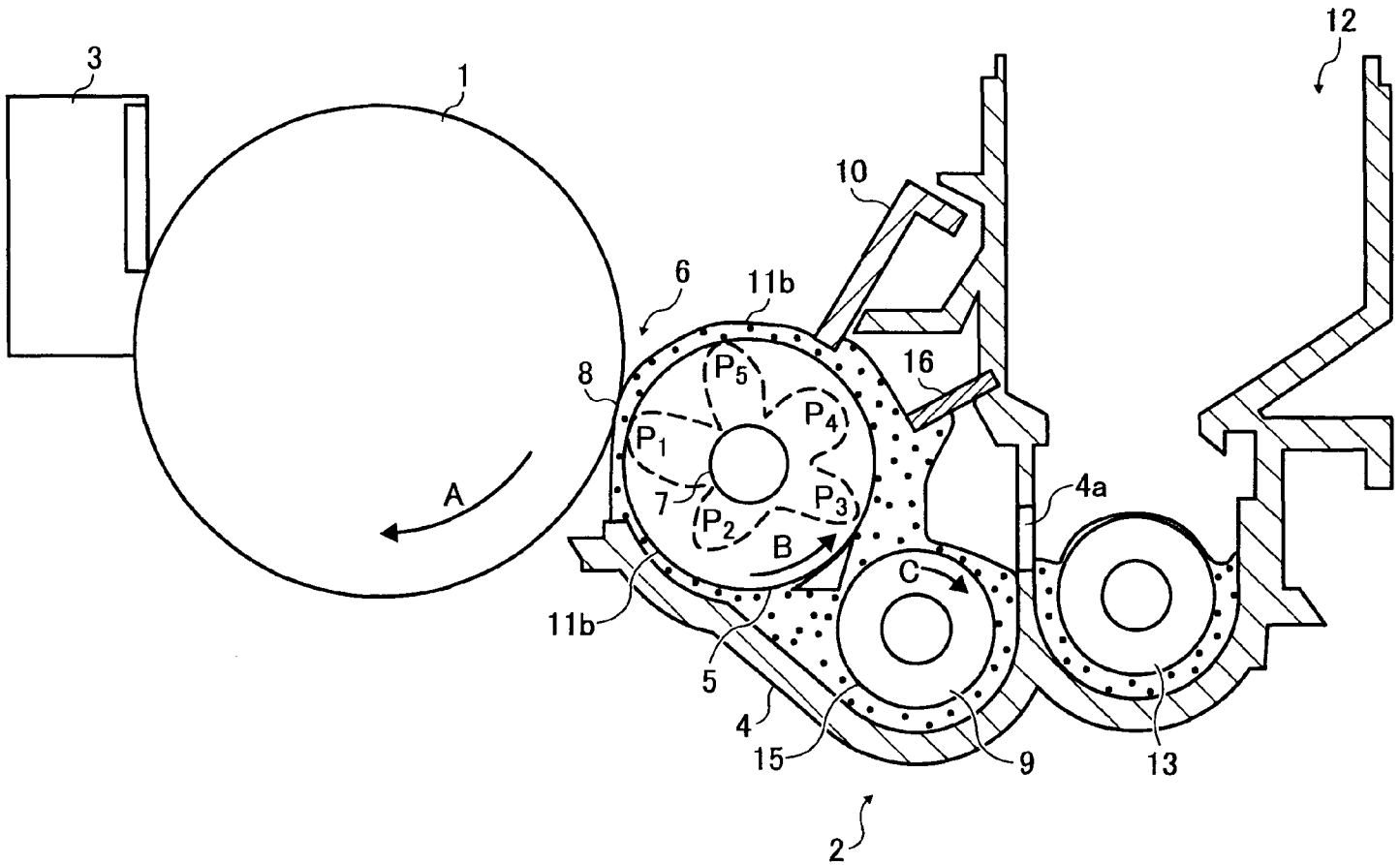
FIG. 1 is a cross-sectional view showing a schematic configuration of the process cartridge of the present invention.

FIG. 1 shows a schematic configuration of a process cartridge of the present embodiment. In the drawing, reference numeral 1 designates a drum-like photoreceptor, which is a latent image carrier for carrying a latent image, reference numeral 2 designates a developing device that makes the latent image visible, and reference numeral 3 designates a cleaning device that cleans the photoreceptor 1 by removing transferred residual toner remaining on the photoreceptor 1 after a visible toner image is transferred to a recording paper, the toner image being obtained by making the latent image visible by the developing device.

The process cartridge of the present embodiment is obtained by integrally assembling the photoreceptor 1, developing device 2 and cleaning device 3. The process cartridge can be incorporated in an after-mentioned image forming apparatus to perform image formation processing, or can be removed from the image forming apparatus so that the photoreceptor 1, developing device 2 and cleaning device 3 can be easily maintained, repaired or replaced. The members incorporated in the process cartridge are not limited to the photoreceptor 1, developing device 2 and cleaning device 3, thus, for example, a member obtained by integrally assembling only the developing device 2 and photoreceptor 1, or a charging device for uniformly charging the surface of the photoreceptor may be added to the process cartridge described in the above embodiment.

The present embodiment is characterized by the structure of the developing device 2, thus the developing device 2 is mainly described.

The developing device 2 of the present embodiment is disposed on the side of the photoreceptor 1, as shown in FIG. 1. A developing sleeve 5 serving as the developer carrier is disposed such that a part thereof is exposed to the outside of the photoreceptor 1 from an opening section 6 of a developer container 4 accommodating a removed developer and a toner for replenishment, which are described hereinafter. The developing sleeve 5 is rotary driven in the direction of an arrow B by driving means, not shown, and has, as magnetic field generating means, a magnet roll 7 that is fixedly disposed in the magnetic sleeve and composed of a plurality of stationary magnets. The magnet roll 7 has five magnetic poles, P1 (south pole), P2 (north pole), P3 (north pole), P4 (south pole) and P5 (north pole), which are arranged in the direction of rotation of the developing sleeve in this order starting from a developing position 8 that is a region facing the photoreceptor 1.

Figure 2:
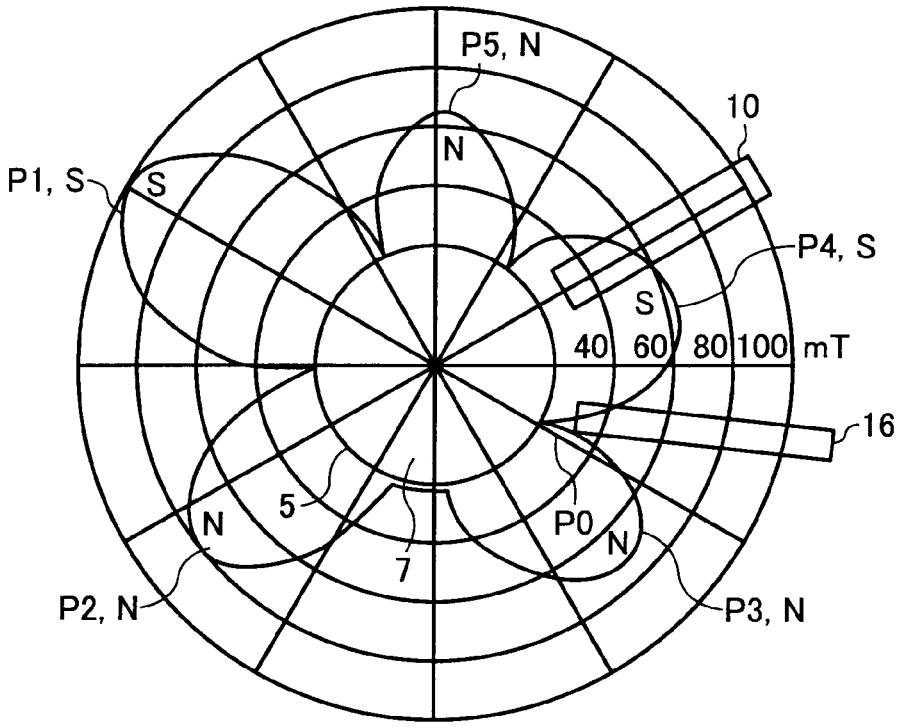
FIG. 2 is a waveform diagram showing a distribution of normal magnetic flux density of a magnet roll used in the developing device according to the first embodiment of the present invention.

These five magnetic poles, P1, P2, P3, P4 and P5, show a distribution of normal magnetic flux density as shown in FIG. 2. The magnetic pole P1 facing the photoreceptor 1 has the largest magnetic field in order to reliably supply the toner to the photoreceptor 1 rotating in the direction of an arrow A.

The magnetic poles P2 and P3 are of the same polarity and thus generate a repulsive magnetic force to remove a residual developer 11*a* carried on the developing sleeve 5 and return it into the developer container 4.

It should be noted that the distribution of the magnetic flux density shown in FIG. 2 and the arrangement of the magnetic poles are merely an example, thus the number of magnetic poles and the arrangement thereof are not limited to the pattern described above. Therefore, the developing sleeve 5 can carry, on the surface thereof, a two-component developer 11 (referred to as "developer" hereinafter) having a toner and a magnetic carrier, as a magnetic brush.

A doctor blade 10, which is the developer regulating member for regulating the amount of developer 11 to be supplied to the photoreceptor 1, is placed on the periphery of the developing sleeve 5, whereby the thickness of a layer of the developer 11 carried on the developing sleeve 5 is regulated by a doctor gap formed between the doctor blade 10 and the developing sleeve 5.

Inside the developer container 4, there is placed a stirring member 9, such as a screw, which is rotary driven by unshown driving means in the direction of an arrow C. This stirring member 9 forms a region for stirring and mixing the removed toner 11*a*, which is removed from the developing sleeve 5 by the magnetic poles P2 and P3, and a toner to be replenished (stirring section 15). The toner to be replenished is fed from a toner replenishing section 12 to the stirring section 15 by an auger 13 via a toner replenishing opening 4*a* formed on the developer container 4. In this manner, the toner and the magnetic carrier are stirred and mixed by the stirring member 9, whereby a predetermined toner charge amount is obtained. It is preferred that the toner charge amount on the developing sleeve 5 be in a range of −10 to −25 (μC/g). The toner can have a magnetic material and be used as a magnetic toner.

On the periphery of the developing sleeve 5, there is disposed blade-shaped developer accumulation means 16, which is attached to the developer container 4 at a position between the doctor blade 10 and the stirring section 15 and in the vicinity of the stirring section 15, with a predetermined space between the developing sleeve 5 and the developer accumulation means 16. The developer accumulation means 16 prevents partial conveyance of a mixture 11*b* of the removed toner 11*a* and toner carried on the developing sleeve 5 so that the mixture accumulates, and the accumulated mixture 11*b* is sent back to the stirring section 15, stirred, and mixed by the stirring section 15 again, whereby sufficient toner charge amount can be obtained.

Therefore, in the developer 11 having the sufficiently charged toner, only a small amount of developer 11 that passes through the space between the developer accumulation means 16 and the developing sleeve 5 is conveyed to the doctor blade 10. The layer thickness of the developer 11 is regulated by the doctor blade 10, and the developer 11 can be conveyed to the developing position 8 without generating a large quantity of accumulated developer before the doctor blade 10. Therefore, the increase of the uncharged toner can be inhibited, and excellent image formation can be maintained.

Incidentally, the developing device 2 of the present embodiment sends excess developer back to the stirring section 15 by means of the developer accumulation means 16 that is disposed on the upstream side of the developer conveyance direction (direction B) higher than the doctor blade 10. By disposing this developer accumulation means 16, the amount of the developer that is held by the magnetic pole P4 facing the doctor blade 10 (referred to as "amount of accumulated developer" hereinafter) is adjusted to be equal to or less than twice the amount of developer passing through the developer regulating member. It should be noted that the amount of accumulated developer is the amount of the developer that is held between, on the developing sleeve 5, the position of the magnetic pole P4 facing the doctor blade 10 and the position where the normal magnetic flux density distribution value of the magnetic pole P4 becomes zero (P0). This amount of developer may be measured by taking the developing sleeve 5 outside the developing device 2, with the doctor blade 10 attached thereto, after the developing sleeve 5 is rotated once, and then collecting the developer accumulated in the developing sleeve 5.

Regarding the amount of accumulated developer in front of the doctor blade 10, there are methods of reducing the magnetic field of the magnetic pole P4 shown in, for example, FIG. 1 and controlling the amount of developer to be supplied from the developer container 4 to the developing sleeve 5, but it is difficult to stably control the amount supplied using these methods, due to the effects of the stirring member 9 disposed on the stirring section 15. Therefore, the developer accumulation means 16 that accumulates the excess developer after the developer is supplied from the stirring section 15 once and controls the amount of the accumulated developer is provided between the stirring section 15 and the doctor blade 10 to adjust the amount of the accumulated developer, whereby the amount of developer passing through the doctor blade 10 is stabilized without being influenced by the amount supplied by the stirring member 9, whereby the degree of stress applied to the developer 11 can be reduced.

In the developing device having the above-described configuration, the developer 11 on the developing sleeve 5 is conveyed as the developing sleeve 5 rotates in the direction of the arrow B, and the layer thickness of the developer 11 is regulated by the doctor blade 10 to be thinned. The developer 11, the layer thickness of which is reduced, is conveyed to the developing position 8 that faces the photoreceptor 1 rotating in the direction of the arrow A. A developing bias is applied to the developing sleeve 5 by a power source, which is not shown. In the developing position 8, the toner in the developer 11 is supplied to the electrostatic latent image formed on the surface of the photoreceptor 1, the electrostatic latent image is then made visible, and development is performed. A development gap GP, which is a gap between the photoreceptor 1 and the developing sleeve, can be set within a conventional range of 0.8 mm to 0.4 mm, and development efficiency can be improved by setting the value of the development gap small.

Second Embodiment

Figure 3:
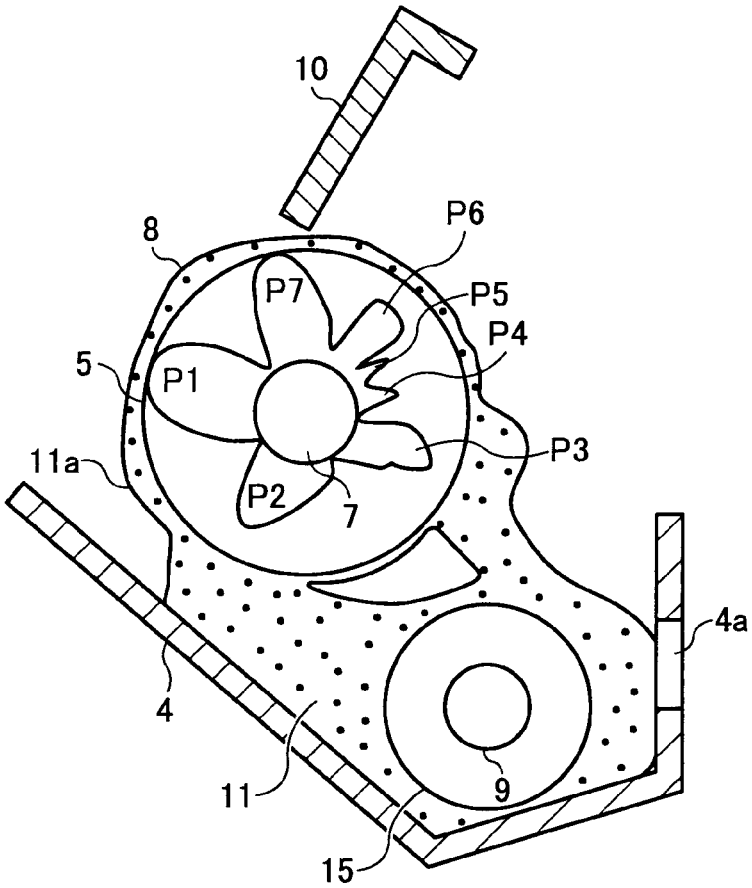
FIG. 3 is a cross-sectional view showing a schematic configuration of the developing device according to the second embodiment of the present invention.

FIG. 3 shows a schematic configuration of the developing device of the present embodiment. In the drawing, the same reference numerals are applied to the same components used in the first embodiment, thus the overlapping explanations are omitted.

Figure 4:
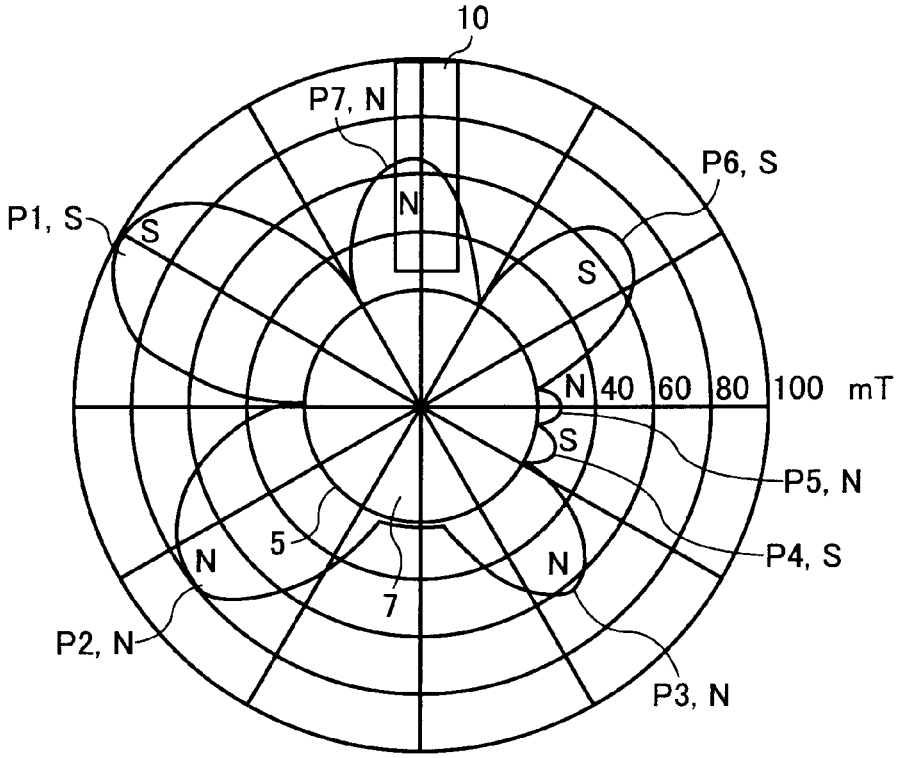
FIG. 4 is a waveform diagram showing a distribution of the normal magnetic flux density of the magnet roll used in the developing device of the second embodiment.

The developing device 2 of the present embodiment has basically the same configuration as the one described in the first embodiment, but the number and arrangement of the magnetic poles within the magnet roll 7 are different. Also, regarding the developer accumulation means 16, a magnetic force is used in place of the blade-shaped developer regulating member to cause accumulation of the developer 11. Specifically, the magnet roll 7 has seven magnetic poles, P1 (south pole), P2 (north pole), P3 (north pole), P4 (south pole), P5 (north pole), P6 (south pole), and P7 (north pole), as shown in FIG. 4, wherein the magnetic pole P1 faces the photoreceptor 1 and P7 faces the doctor blade 10. The magnetic poles P4 and P5 that have a minute magnetic field of 20 mT (militesla) or lower are provided between the magnetic pole P7 and the magnetic pole P3 adjacent to the stirring member 9. The endurance of the developer on the developing sleeve 5 is weakened by the magnetic force generated between these minute magnetic fields P4 and P5, causing accumulation of the developer 11. Therefore, P4 and P5 cause the same developer accumulation as the developer accumulation means 16 of the above-described first embodiment.

Figure 5:
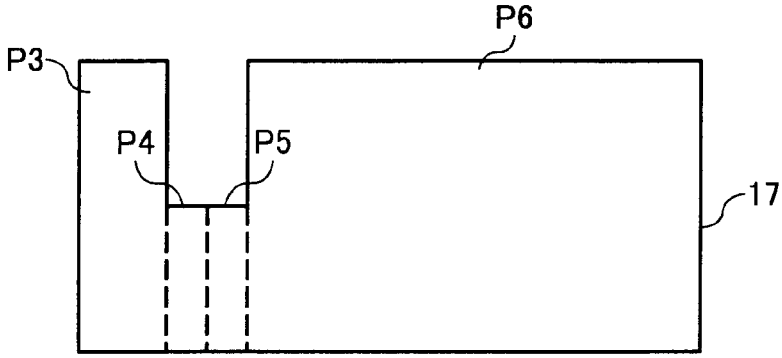
FIG. 5 is a plan view showing a magnet structure of a part of the magnet roll used in the developing device of the second embodiment.

In this manner, by setting the magnitude of the magnetic poles P4 and P5 to be equal to or lower than 20 mT, the developer 11 is held only on the surface of the developing sleeve 5, and the amount of accumulated developer can be easily adjusted to be equal to or less than twice the amount of developer passing through the developer regulating member. According to a method of obtaining such magnetic fields, a concave groove 18 with minute width is formed on a magnet, and the magnetic poles P3 through P6 are formed, as shown in FIG. 5. In this method, one magnet is processed even with a small multipole magnetic field, thus there is no problem in obtaining accuracy generated when handling a minute magnet. Therefore, use of this method is advantageous in terms of costs. It should be noted that an electric magnet may be used in place of the magnet. In this case, an advantage is that the size of the magnetic fields can be changed by changing the amount of current, thus, even if the property of the developer 11 fluctuates primarily, the layer thickness of the developer 11 can be changed appropriately by monitoring the fluctuation.

In this manner, by using the magnetic fields as the means for accumulating the excess developer 11 after the developer 11 is supplied from the stirring section 15 once, the amount of the developer 11 can be adjusted without contacting with the developer, thus the layer thickness of the developer can be thinned without applying new stress to the developer. Moreover, it is only necessary to change the design of the magnet to be disposed inside the developing sleeve 5, thus it is not necessary to dispose any new members, which is advantageous in realizing a small device.

Third Embodiment

Figure 6:
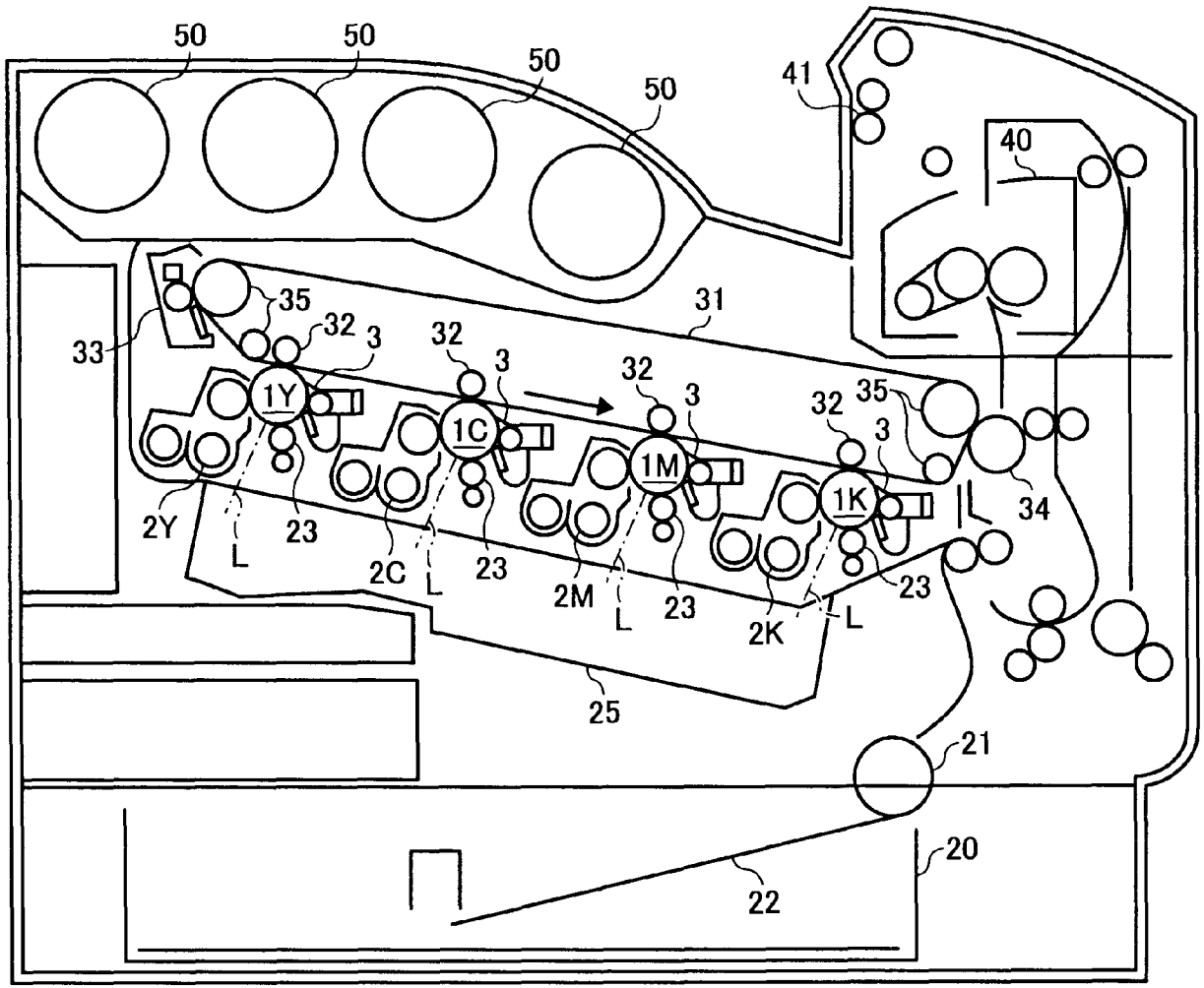
FIG. 6 is a cross-sectional view showing a schematic configuration of the image forming apparatus according to the third embodiment of the present invention.

FIG. 6 shows a schematic configuration of the image forming apparatus that uses the developing device 2 of the first or second embodiment described above. In the drawing, reference numerals 1Y, 1C, 1M and 1K designate, respectively, photoreceptors that form toner images in colors of yellow (Y), cyan (C), magenta (M) and black (K). Reference numerals 2Y, 2C, 2M and 2K designate, respectively, developing devices that have the structure described in the first and second embodiments and store the toners of these colors. Reference numeral 23 designates a charging deice, and reference numeral 3 designates a cleaning device that cleans the surface of each photoreceptor. Reference numeral 25 designates an exposure device that emits a laser beam L corresponding to each toner color to each of the photoreceptors 1Y, 1C, 1M and 1K to form an electrostatic latent image. Reference numeral 31 designates an endless intermediate transfer belt that is wrapped around rollers 35 so that the toner images of the respective colors are transferred from the photoreceptor drums 1Y, 1C, 1M and 1K by transfer rollers 32. Reference numeral 33 designates cleaning means for cleaning the intermediate transfer belt 31. Reference numeral 34 designates a secondary transfer roller that transfers the toner images from the intermediate transfer belt 31 to a transfer sheet 22 that is reeled out from a paper-feeding unit 20 by a reeling roller 21. Reference numeral 40 designates a fixing device that thermally presses and fixes the toner images formed on the transfer sheet 22 transferred from the intermediate belt 31. Reference numeral 41 designates a paper-discharging roller that discharges the transfer sheet on which the toner images are fixed. Reference numeral 50 designates a toner bottle that supplies the toner to each developing device.

In this image forming apparatus, an electrostatic latent image is formed on each of the photoreceptor drums 1Y, 1C, 1M and 1K by the laser beam L that corresponds to each toner color and is emitted from the exposure device 25, and each of the toner color is adhered to the electrostatic latent image from each of the developing devices 2Y, 2C, 2M and 2K, whereby toner images corresponding to the respective toner colors are formed. The toner images formed in this manner are transferred to the intermediate transfer belt 31. The toner images transferred to the intermediate transfer belt 31 are then transferred to the transfer sheet 22 and fixed by the fixing device, and printing is performed.

Next, the image forming apparatus of the present embodiment is used, and the developing device described in the first and second embodiments, and, as a comparative example, the developing device from which the developer accumulation means 16 is removed in the first embodiment are used to drive the developing device 2K only, and the rate of uncharged toner within the developer 11 is measured for each driving time period. Here, the doctor gap is set such that the amount of developer passing through the doctor blade 10 becomes 0.5 $mg/cm^2$. Then, only the developing devices were driven when the linear velocity of the developing sleeve 5 was 200 mm/sec, and the rate of the toner that was not negatively charged was measured. In the measurement, the E-Spart analyzer manufactured by Hosokawa Micron, Ltd. was used to sample 5000 toners, measure charged amount of each toner, and obtain the rate of the toners that are not negatively charged, out of the 5000 toners.

As other specific conditions, the diameter of each photoreceptor was set to 50 mm, and the linear velocity was set to 200 mm/sec. The diameter of the developing sleeve was set to 18 mm, charging potential VD of the photoreceptor 1 before exposure to −350 V, potential VL after exposure to −50 V, and developing bias voltage VB to −250 V, that is, a developing potential (VL−VB=200 V).

Figure 7:
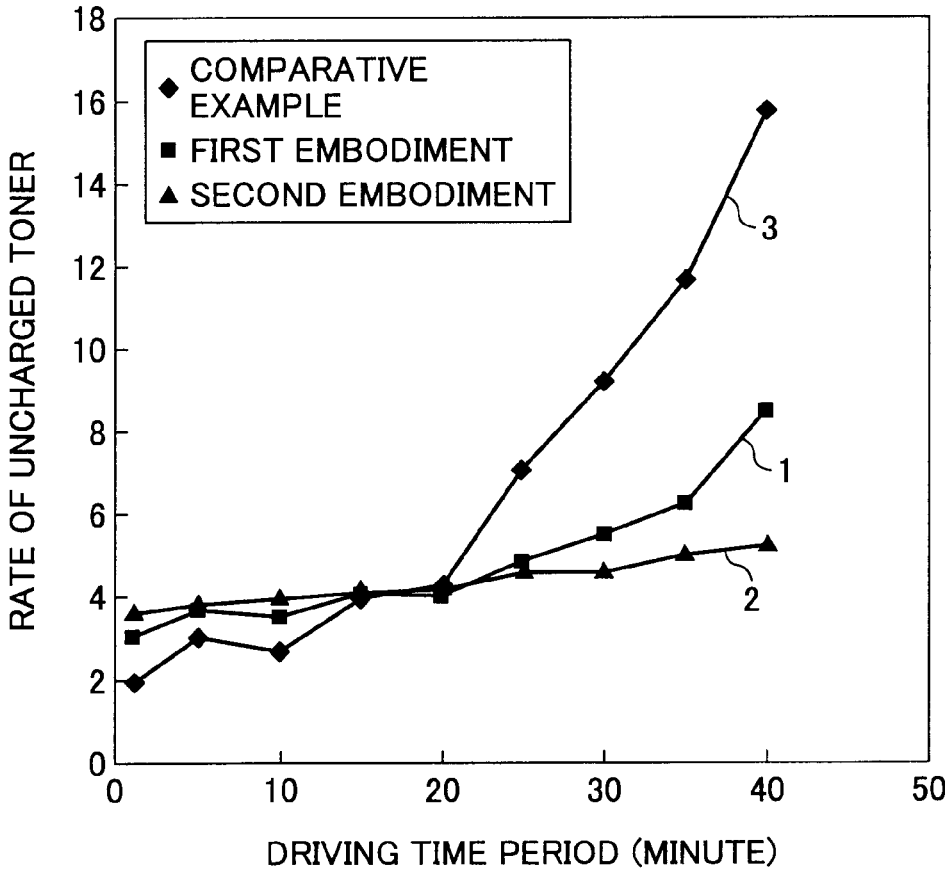
FIG. 7 is a figure showing, in the form of a graph, the relationship between the driving time period in which a developing sleeve is rotary driven and the rate of uncharged toner in a developer.

FIG. 7 shows the results of measurement. A curved line 1 in the drawing shows the first embodiment, a curved line 2 shows the second embodiment, and a curved line 3 shows the comparative example 1. According to these results, it is clear that in the first and second embodiments the rate of the uncharged toner is not much increased even when the developing devices were driven for a long time, compared to the comparative example. Furthermore, these developing devices were used to form an image, and the image was evaluated. In the comparative example, the occurrence of an abnormal image with a scumming or the like was found after 30 minutes of driving, but an excellent image with no scumming or the like was obtained in the first and second embodiments.

Fourth Embodiment

Figure 8:
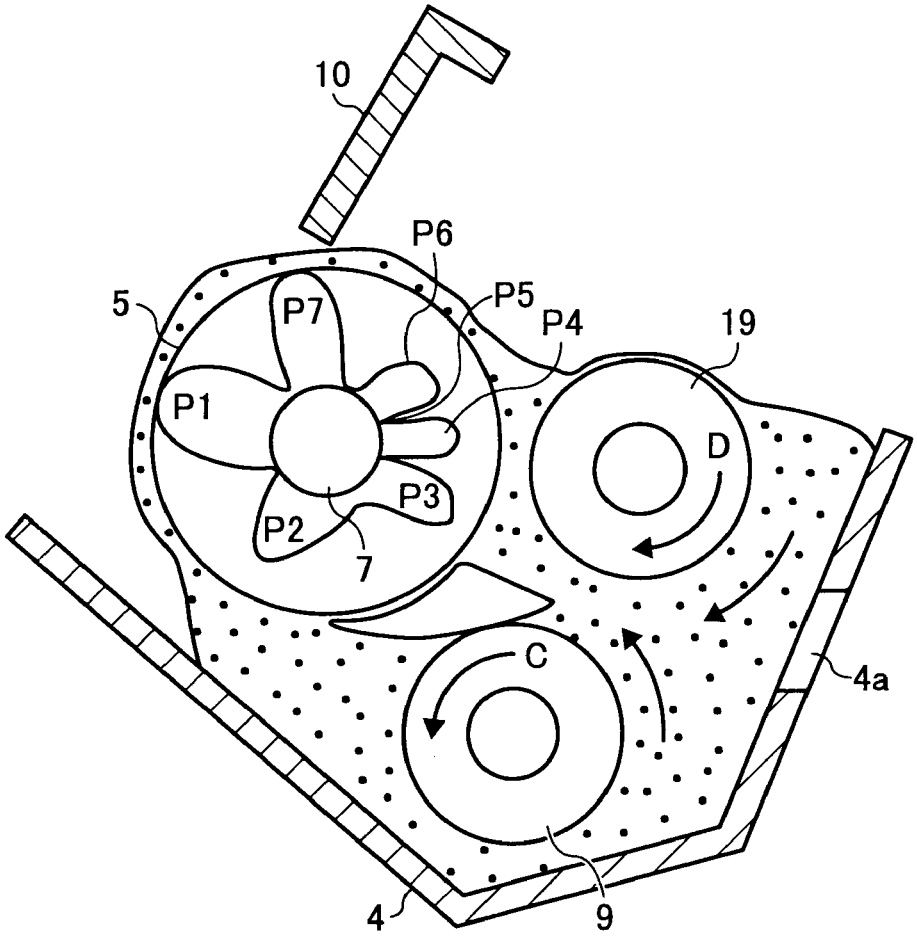
FIG. 8 is a cross-sectional view showing a schematic configuration of the developing device according to the fourth embodiment of the present invention.
Figure 9:
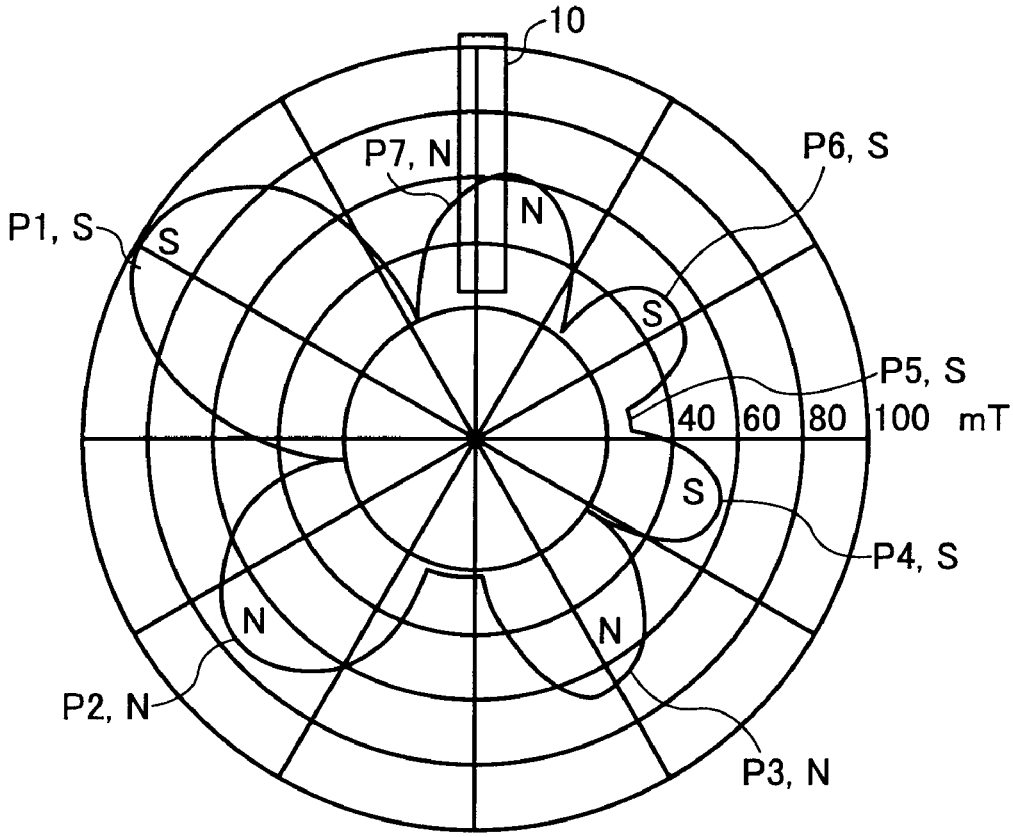
FIG. 9 is a waveform diagram showing a distribution of the normal magnetic flux density of the magnet roll used in the developing device of the fourth embodiment.

FIG. 8 shows a schematic configuration of the developing device of the present embodiment. Also, FIG. 9 shows an arrangement of the magnetic poles of the magnet roll 7 and a distribution of the normal magnetic flux density of the magnet roll 7. In FIG. 8, the same reference numerals are applied to the same components used in the first embodiment, thus the overlapping explanations are omitted.

As with the developing device described in the second embodiment, in the development of the present embodiment, the magnetic fields are used to accumulate the developer 11.

The developer drawn up from the magnetic pole P3 passes through the magnetic pole P4. The magnetic poles P4 and P6 are of the same polarity, thus a force applies in a direction in which the developer is separated from the developing sleeve 5. At this moment, the normal magnetic flux density of the magnetic pole P5 that is a repulsive magnetic field with respect to the magnetic poles P4 and P6 is formed to be equal to or lower than 20 mT, whereby the layer thickness of the entire developer is thinned without causing the developer to be separated at the magnetic pole P4, and the developer is conveyed to the doctor blade 10 disposed on the magnetic pole P7. Particularly, by disposing such a repulsive magnetic field in front of the doctor blade, the separated developer is subjected to the process in which the separated developer is disposed in the vicinity of the magnetic pole P4, stirred by a screw 19 rotating in the direction of an arrow D, sent back to the lower stirring member 9, and captured by the developing sleeve 5 at the magnetic pole P3.

In this manner, by using the magnetic fields P4 through P6, the developer 11 can be appropriately accumulated at the position adjacent to the stirring section 15, thus the occurrence of the uncharged toner can be prevented. Moreover, stirring distance of the developer is increased in spite of the narrow space, thus toner dispersibility is improved, and a high-quality image with no uneven density can be produced. The image was formed using the image forming apparatus shown in FIG. 6. At this moment, two types of components that have the waveform formed by the magnetic poles as shown in FIG. 2 and FIG. 9 were prepared in place of the magnet roll 7, to form ten solid images continuously. When the magnet roll that has the waveform formed by the magnetic poles as shown in FIG. 2 was used, uneven image density was confirmed on the eighth solid image and thereafter, but almost no uneven image density was observed when the magnet roll that has the waveform formed by the magnetic poles as shown in FIG. 9 was used.

As described above, by adopting the above-described configurations, the present invention can provide a developing device, which can inhibit the increase of the rate of uncharged toner caused by long hours of operation and develop an excellent image, and a process cartridge and image forming apparatus that use such a developing device.

Various modifications will become possible for those skilled in the art after receiving the teachings of the present disclosure without departing from the scope thereof.

What is claimed is:

1. A developing device, comprising:

a latent image carrier to carry a latent image;

a developer carrier having therein a plurality of magnetic poles to generate a magnetic field, and carrying and conveying a two-component developer including a toner and a magnetic carrier;

a developer regulating member to regulate a layer thickness of the two-component developer carried and conveyed by the developer carrier;

a stirring section to stir the toner and the two-component developer removed from the developer carrier; and developer accumulation means for accumulating the two-component developer between the stirring section and the developer regulating member, wherein a portion of the two-component developer is fed back to the stirring section by the developer accumulation means, at least two pairs of the magnetic poles of a same polarity are disposed in a developing sleeve such that a first pair of the magnetic poles of the same polarity is disposed adjacent to a second pair of the magnetic poles of the same polarity, the developer accumulation means includes the plurality of magnetic poles disposed in a magnetic field generating means, both the first pair of the magnetic poles of the same polarity and the second pair of the magnetic poles of the same polarity are arranged on the developer carrier in a range downstream of a magnetic pole facing the latent image carrier and upstream of the developer regulating member in a direction of rotation of the developer carrier, and an additional magnetic pole is disposed in the developing sleeve downstream of the first and second pairs of the magnetic poles having the same polarity, the developer regulating member being disposed on the additional magnetic pole.

2. The developing device as claimed in claim 1, wherein the developer accumulation means regulates an amount of the two-component developer such that an amount of the two-component developer carried on an upstream side of a developer conveyance direction of the developer carrier upstream from the developer regulating member is equal to or less than twice an amount of the two-component developer passing through the developer regulating member.

3. The developing device as claimed in claim 1, wherein the developer accumulation means is formed in a shape of a blade.

4. The developing device as claimed in claim 1, wherein the plurality of magnetic poles include a magnetic pole having a normal magnetic flux density of 20 mT or lower.

5. A process cartridge including a developing device, wherein the developing device comprises:

a latent image carrier to carry a latent image;

a developer carrier having therein a plurality of magnetic poles to generate a magnetic field, and carries and conveys a two-component developer including a toner and a magnetic carrier;

a developer regulating member to regulate a layer thickness of the two-component developer carried and conveyed by the developer carrier;

a stirring section to stir the toner and the two-component developer removed from the developer carrier; and developer accumulation means for accumulating the two-component developer between the stirring section and the developer regulating member, wherein a portion of the two-component developer is fed back to the stirring section by the developer accumulation means, at least two pairs of the magnetic poles of a same polarity are disposed in a developing sleeve such that a first pair of the magnetic poles of the same polarity is disposed adjacent to a second pair of the magnetic poles of the same polarity, the developer accumulation means includes the plurality of magnetic poles disposed in a magnetic field generating means, both the first pair of the magnetic poles of the same polarity and the second pair of the magnetic poles of the same polarity are arranged on the developer carrier in a range downstream of a magnetic pole facing the latent image carrier and upstream of the developer regulating member in a direction of rotation of the developer carrier, and an additional magnetic pole is disposed in the developing sleeve downstream of the first and second pairs of the magnetic poles having the same polarity, the developer regulating member being disposed on the additional magnetic pole.

6. An image forming apparatus including a developing device, wherein the developing device comprises:

a latent image carrier to carry a latent image;

a developer carrier having therein a plurality of magnetic poles to generate a magnetic field, and carries and conveys a two-component developer including a toner and a magnetic carrier;

a developer regulating member to regulate a layer thickness of the two-component developer carried and conveyed by the developer carrier;

a stirring section to stir the toner and the two-component developer removed from the developer carrier; and developer accumulation means for accumulating the two-component developer between the stirring section and the developer regulating member, wherein a portion of the two-component developer is fed back to the stirring section by the developer accumulation means, at least two pairs of the magnetic poles of a same polarity are disposed in a developing sleeve such that a first pair of the magnetic poles of the same polarity is disposed adjacent to a second pair of the magnetic poles of the same polarity, the developer accumulation means includes the plurality of magnetic poles disposed in a magnetic field generating means, both the first pair of the magnetic poles of the same polarity and the second pair of the magnetic poles of the same polarity are arranged on the developer carrier in a range downstream of a magnetic pole facing the latent image carrier and upstream of the developer regulating member in a direction of rotation of the developer carrier, and an additional magnetic pole is disposed in the developing sleeve downstream of the first and second pairs of the magnetic poles having the same polarity, the developer regulating member being disposed on the additional magnetic pole.

7. The process cartridge as claimed in claim 5, wherein the developer accumulation means regulates an amount of the two-component developer such that an amount of the two-component developer carried on an upstream side of a developer conveyance direction of the developer carrier upstream from the developer regulating member is equal to or less than twice an amount of the two-component developer passing through the developer regulating member.

8. The process cartridge as claimed in claim 5, wherein the developer accumulation means is formed in a shape of a blade.

9. The process cartridge as claimed in claim 5, wherein the plurality of magnetic poles include a magnetic pole having a normal magnetic flux density of 20 mT or lower.

10. The image forming apparatus as claimed in claim 6, wherein the developer accumulation means regulates an amount of the two-component developer such that an amount of the two-component developer carried on an upstream side of a developer conveyance direction of the developer carrier upstream from the developer regulating member is equal to or less than twice an amount of the two-component developer passing through the developer regulating member.

11. The image forming apparatus as claimed in claim 6, wherein the developer accumulation means is formed in a shape of a blade.

12. The image forming apparatus as claimed in claim 6, wherein the plurality of magnetic poles include a magnetic pole having a normal magnetic flux density of 20 mT or lower.

13. The developing device as claimed in claim 1, wherein the first pair has a different polarity from the second pair.

14. The process cartridge as claimed in claim 5, wherein the first pair has a different polarity from the second pair.

15. The image forming apparatus as claimed in claim 6, wherein the first pair has a different polarity from the second pair.

16. The developing device as claimed in claim 1, wherein the magnetic pole facing the latent image carrier has the largest magnetic field of the plurality of magnetic poles.

17. The developing device as claimed in claim 1, wherein the additional magnetic pole is adjacent to the second pair and has a polarity opposite from a polarity of the second pair.

* * * * *